United States Patent [19]

Saito

[11] 4,274,031

[45] Jun. 16, 1981

[54] COLOR TUBE HAVING SHIELD CORRECTING FOR TERRESTRIAL MAGNETISM

[75] Inventor: Yuji Saito, Tokyo, Japan

[73] Assignee: Nippon Electric Co., Ltd., Japan

[21] Appl. No.: 11,633

[22] Filed: Feb. 12, 1979

[30] Foreign Application Priority Data

Feb. 17, 1978 [JP] Japan ..... 63-17805

[51] Int. Cl.[3] ..... H01J 29/06; H01J 29/07; H01J 29/81

[52] U.S. Cl. ..... 313/407; 313/403; 315/8

[58] Field of Search ..... 313/402, 403, 404, 407; 315/8

[56] References Cited

U.S. PATENT DOCUMENTS

| | | | |
|---|---|---|---|
| 3,243,645 | 3/1966 | Parnes et al. | 313/402 |
| 3,549,932 | 12/1970 | Lindeman | 313/407 |
| 4,019,085 | 4/1977 | Sakata | 313/479 X |

FOREIGN PATENT DOCUMENTS

| | | | |
|---|---|---|---|
| 959911 | 12/1974 | Canada | 313/402 |

OTHER PUBLICATIONS

1974 National Convention of the Institute of Television Engineers of Japan, "Inner Shield For Color Picture Tube Section", 9–13, p. 221.

*Primary Examiner*—Robert Segal
*Attorney, Agent, or Firm*—Charles W. Helzer

[57] ABSTRACT

The color picture tube is provided with a terrestrial magnetism correcting member contained in the tube and combined with a shadow mask assembly. The correcting member is shaped as a rectangular box made up of a pair of vertical magnetic side plates extending from the opposed sides of the supporting frame of the shadow mask and a second pair of horizontal magnetic plates interconnecting the upper and lower ends of the vertical side plates.

3 Claims, 10 Drawing Figures

COLOR TUBE HAVING SHIELD CORRECTING FOR TERRESTRIAL MAGNETISM

BACKGROUND OF THE INVENTION

This invention relates to a color picture tube with stripe shaped phosphors, and more particularly to a color picture tube wherein a terrestrial magnetism compensating or correcting member is contained in the envelope of the tube.

In a conventional color picture tube, due to the effect of terrestrial magnetism the electron beams are deviated from their normal paths so that they do not land on the correct positions on the fluorescent screen with the result that the color purity of the reproduced picture is impaired thus degrading the quality of the picture.

For this reason, in a large size color picture tube, for the purpose of preventing terrestrial magnetism from affecting the electron beams, a magnetic shielding member is disposed on the outer wall or inside of the tube but in most of the small size color picture tubes it has been impractical to provide such magnetic shielding member from the standpoint of cost and construction.

The relationship between terrestrial magnetism and the landing of the electron beam on the fluorescent screen will first be considered.

The horizontal intensity of the terrestrial magnetism is the largest at or near the equator but it decreases gradually toward the north and south magnetic poles of the earth, while the relation becomes contrary as to the vertical intensity of the terrestrial magnetism. For example, the vertical component of the terrestrial magnetism which greatly affects the color picture tube with stripe shaped phosphors varies from 0 to 0.7 gauss between the equator and the poles. The relationship between the vertical component of the terrestrial magnetism and the beam landing is shown in FIG. 1 in which the outer frame represents the size of the picture. In this example, the tube has a size of 12 inches. The data represents the error at portions where the data are written, and the arrows show the direction in which error occurs, the horizontal direction in this example. Taking 0.35 gauss as an example, which represents the average value of the vertical component in Japan, and taking as a reference a case wherein the effect of the horizontal terrestrial magnetism is zero (0 gauss) the landing error of various portions of the picture is one half of that of FIG. 1 as shown by FIG. 2. Where the landing error at the center of the picture is adjusted to be zero by a purity adjusting correction magnet mounted on the outside of the neck portion of the envelope in a manner well known in the art, the landing error can be reduced by 28.5 microns throughout the picture, as shown in FIG. 3.

However, as can be noted from FIG. 3, in a color picture tube not provided with terrestrial magnetism compensating means, although it is possible to reduce to zero the landing error at the center of the picture by the purity adjusting correction magnet, it is impossible to reduce to zero the landing error on both sides of the center. This is due to the fact that the length of travel of the electron beams increases toward the periphery of the picture so that the electrons are more liable to be affected by the terrestrial magnetism thus increasing the deviation of the electron beams. This landing error increases at higher latitude areas.

In addition to the vertical component, the horizontal component of the terrestrial magnetism also causes landing error in the axial direction. The landing error in Japan caused by the horizontal component is the largest when the tube axis is directed in the south to north direction, as shown in FIG. 4. Accordingly, in a conventional color picture tube landing errors are caused by both the vertical and horizontal components of the terrestrial magnetism.

For the purpose of decreasing the beam landing error caused by the terrestrial magnetism throughout the picture, it has been proposed to include a terrestrial magnetism correction member in the tube.

In one example shown in FIG. 5, a quadilateral frustum shaped shielding member 15 is mounted on the back of a supporting frame 11 of a shadow mask assembly 10, the shielding member having a base aligned with the periphery of the funnel 12*a* of an envelope 12. Reference numeral 13 represents a shadow mask. Such construction is disclosed, for example, in U.S. Pat. No. 3,549,932.

Although this construction can substantially decrease the adverse effect of the terrestrial magnetism in comparison to a conventional color picture tube not provided with such shielding member, there arises the following problems.

Since the size of the magnetic shielding member is the same or larger than the size of the shadow mask a large space is necessary for the surface treatment of the magnetic shielding member, thus decreasing the treating capacity. Furthermore, during the operation of the tube, the temperature of the shadow mask increases due to the scanning of the electron beams, but as the inner surface or the impinged surface of the shadow mask is bounded by the shielding member, heat radiation is prevented thus causing deformation of the shadow mask. Moreover, with this construction it is necessary to increase the size of the demagnetizing coil wound about the envelope near the fluorescent screen for the purpose of demagnetizing the shadow mask, since a substantial portion of the demagnetizing flux flows through the shielding member instead of the shadow mask. This results in a more incomplete demagnetization of the shadow mask than with a tube not using the shielding member. Accordingly, to demagnetize the shadow mask as desired, it is necessary to increase the demagnetizing current. For the reason described above, use of an internal shield for correcting the terrestrial magnetism as shown in FIG. 5 results in such defects as increasing the manufacturing difficulty and degradation of the tube characteristics. These disadvantages are more serious in a small size color picture tube.

SUMMARY OF THE INVENTION

Accordingly, it is a principal object of this invention to provide an improved color picture tube with stripe shaped phosphors that can minimize the beam landing error on a fluorescent screen caused by terrestrial magnetism.

Another object of this invention is to provide a color picture tube with stripe shaped phosphors capable of decreasing the demagnetizing current required for the shadow mask in a tube employing a terrestrial magnetism correcting member.

A further object of this invention is to provide an improved color picture tube provided with stripe shaped phosphors capable of increasing heat radiation of the shadow mask.

According to this invention, there is provided a color picture tube with stripe shaped phosphors of the type comprising an envelope including a panel with a fluorescent screen made of the stripe shaped phosphors, a funnel and a neck, a shadow mask assembly disposed at a predetermined distance from the fluorescent screen, the shadow mask assembly including a rectangular supporting frame and a shadow mask supported thereby on the side thereof facing the fluorescent screen, an electron gun assembly contained in the neck, and a terrestrial magnetism correcting member mounted on the side of the supporting frame facing the electron gun assembly, wherein the terrestrial magnetism correcting member comprises a pair of vertical magnetic side plates extending from the opposed vertical sides of the supporting frame toward the neck, and a second pair of horizontal magnetic side plates interconnecting the upper and lower ends of the first pair of vertical magnetic side plates on the edges thereof remote from the shadow mask.

DESCRIPTION OF THE PREFERRED EMBODIMENTS

Figure 6:
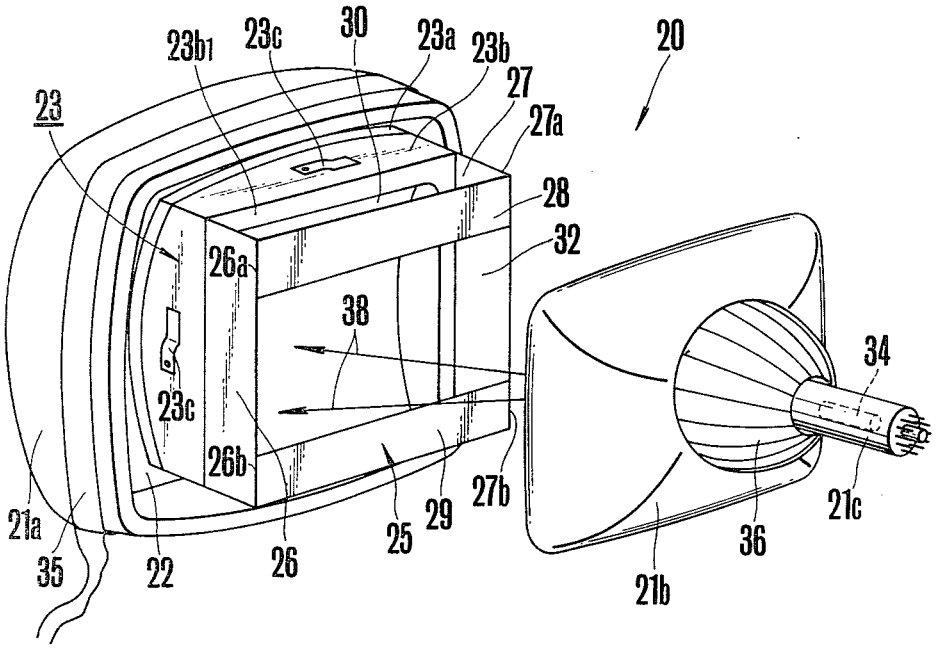
FIG. 6 is an exploded view of a color picture tube embodying the invention and provided with stripe shaped phosphors, which shows the relationship between the shadow mask and the terrestrial magnetism correcting member.

FIG. 6 shows one embodiment of the color picture tube according to the invention and provided with stripe shaped phosphors. The color picture tube 20 shown therein comprises an envelope made up of a panel 21*a*, a funnel 21*b* and a neck 21*c*. On the inside of the panel 21*a* is formed a fluorescent screen 22 coated with well known stripes of phosphors of red, blue and green colors. The fluorescent screen 22 may be of the black stripe type wherein graphite is coated between the stripes of the phosphors, or may be of any other type. A shadow mask assembly 23 is disposed in front of the fluorescent screen 22 at a predetermined distance. The shadow mask assembly 23 comprises a rectangular shadow mask 23*a*, a rectangular supporting frame 23*b* for supporting the same, and leaf springs 23*c* secured to the supporting frame 23*b* for supporting the assembly on the inner wall of the panel 21*a*.

A terrestrial magnetism correcting member or magnetic shielding member 25 according to this invention is mounted on the back of the supporting frame 23*b*. The terrestrial magnetism correcting member 25 is made of magnetic material and shaped as a rectangular box and includes a pair of rectangular vertical magnetic side plates 26 and 27 extending in parallel from the rear sides of the supporting frame 23*b* toward the neck 21*c*. The correction member 25 further comprises a pair of horizontal magnetic side plates 28 and 29 extending in parallel between the ends of the side plates 26 and 27 or between the upper and lower ends 26*a*, 27*a* 26*b* and 27*b*. The side plates 26 and 27 are secured to the supporting frame 23*b* of the shadow mask assembly 23 by suitable means as welding. The first pair of side plates 26, 27 and the second pair of side plates 28 and 29 are assembled by welding, for example or stamped from a single metal plate. Thus, a space 30 with its upper end opened is defined by the upper horizontal side of the supporting frame 23*b*, the upper ends of the vertical side plates 26 and 27 and the upper horizontal side plate 28. In the same manner, a space (not shown) with its lower end opened is defined by the lower horizontal side of the vertical side plates 26 and 27 and the lower horizontal side plate 29. The vertical edges of the vertical side plates 26 and 27 remote from the shadow mask 23*a*, and the horizontal side plates 28 and 29 define an opening 32 in a plane perpendicular to the tube axis. The size of this opening is selected so that the electron beams 38 emitted by an electron gun assembly 34 contained in the neck 21*c* can land on the effective area of the fluorescent screen 22 formed on the inner surface of the panel 21*a*. A demagnetizing coil 35 for demagnetizing the shadow mask is wound about the tube contiguous to the funnel 21*b* of the panel 21*a*. Further, near the joint between the funnel 21*b* and the neck 21*c* is disposed an assembly 36 of a vertical deflection coil and a horizontal deflection coil to deflect the electron beams 38 in the vertical and horizontal directions for causing them to impinge upon the predetermined portions of the fluorescent screen 22.

With this construction, the vertical component of the terrestrial magnetism which passes near the vertical sides of the picture and which otherwise would tend to deflect the electron beams in the horizontal direction, are attracted by the vertical magnetic side plates 26 and 27 thus changing the terrestrial magnetic flux distribution in an area through which the electron beam passes.

Figure 7:
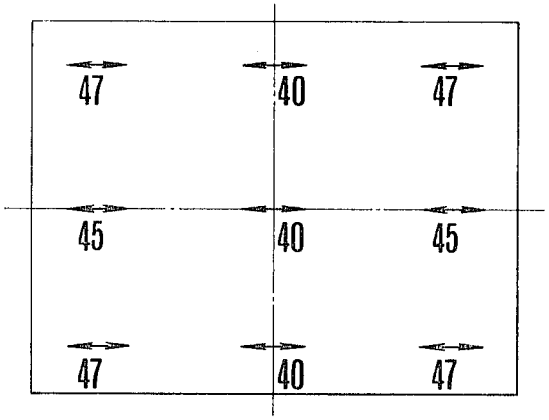
FIG. 7 is a graph similar to FIG. 2 and showing the distribution of the beam landing error caused by the vertical component of the terrestrial magnetism where the color picture tube of this invention shown in FIG. 6 is used but without purity adjustment.

More particularly, the intensity of the terrestrial magnetic field near the vertical side plates 26 and 27 decreases so that the lines of magnetic force in this area distort outwardly in the horizontal direction with respect to the vertical plane containing the tube axis passing through the center of the picture. Consequently, as shown in FIG. 7, on both sides of the horizontal axis of the picture, the landing errors of the beam passing through the magnetic field are equal to that at the center of the picture. The electron beams toward the corners of the picture pass through the field distorted outwardly in the horizontal direction so that the beams would be subjected to a force in the perpendicular direction. As a consequence, the electron beams passing through the terrestrial magnetism correcting member 25 toward the shadow mask assembly 23 and the fluorescent screen 22 are deflected in the horizontal and vertical directions by the correcting member 25. It should be noted, however, that since the fluorescent screen comprises stripe shaped phosphors, the beam landing error in the vertical direction caused by the horizontal component of the terrestrial magnetism is not necessary to be considered. In other words, it is necessary to consider only the horizontal beam deflection error caused by the vertical component so that it is possible to further decrease the beam landing error in comparison to a fluorescent screen that comprises dot matrix type phosphors.

The field distortion described above is also afforded by the horizontal magnetic side plates 28 and 29 thus further decreasing the beam landing error.

The horizontal side plates 28 and 29 of this invention are provided between the upper and lower ends of the vertical magnetic side plates 26 and 27 to define upper and lower openings 30 so that the substantial portion of the magnetic field produced by demagnetizing coil 35 which is most effective to demagnetize the shadow mask passes substantially only through the shadow mask 23*a* and the frame 23*b* having a small reluctance. Accordingly, different from the prior art construction, the terrestrial magnetism correcting member 25 does not decrease the demagnetizing effect.

Figure 1:
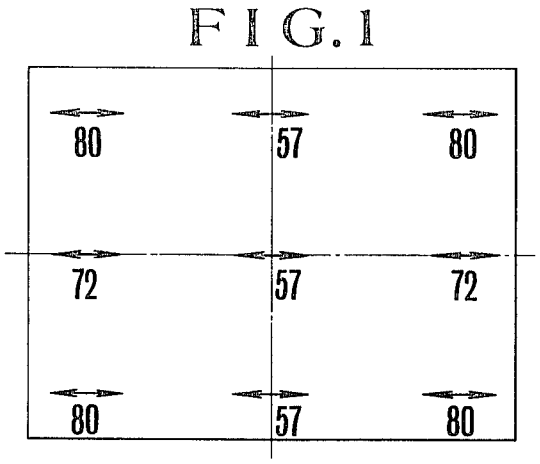
FIG. 1 is a graph showing the distribution of the beam landing error on the fluorescent screen of the stripe phosphor type of a color picture tube not provided with a terrestrial magnetism correcting member, when the vertical component of the terrestrial magnetism is varied.
Figure 2:
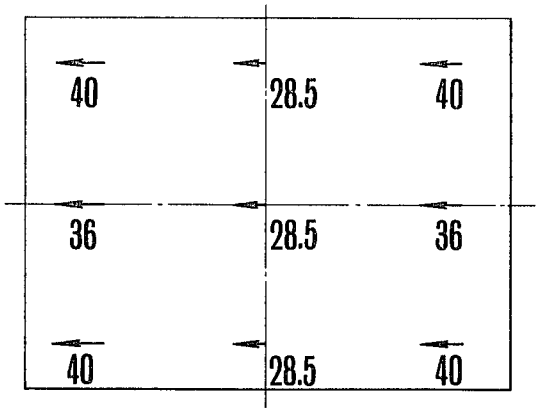
FIG. 2 is a graph showing the distribution of the beam landing error in Japan on the fluorescent screen caused by the vertical component of the terrestrial magnetism.
Figure 3:
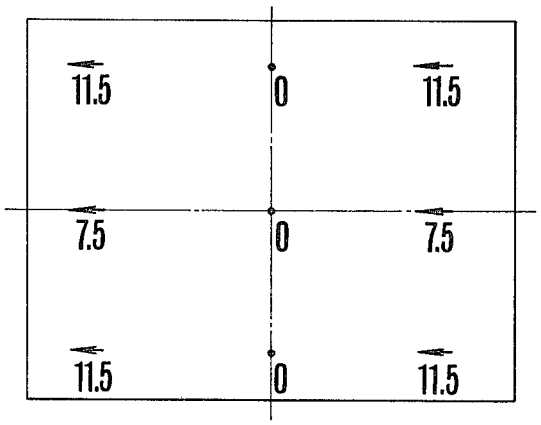
FIG. 3 is a graph showing the distribution of the beam landing error when the landing error at the center of the picture shown in FIG. 2 is adjusted to be zero.
Figure 4:
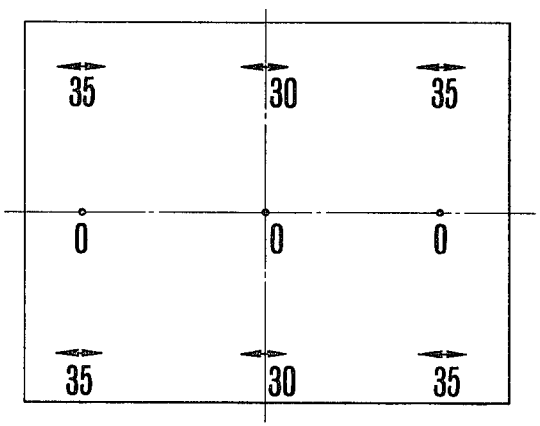
FIG. 4 is a graph showing the distribution of the beam landing error in Japan caused by the horizontal component of the terrestrial magnetism when the picture is directed in the south-north direction.
Figure 5:
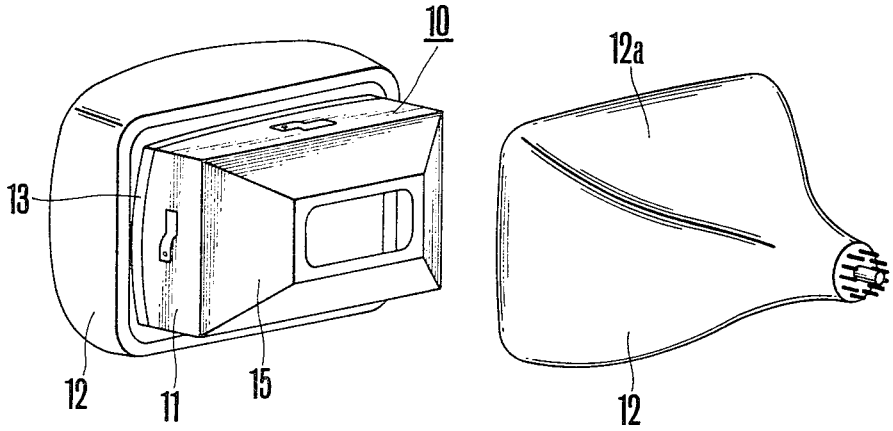
FIG.5 PRIOR ART
FIG. 5 is an exploded view of a prior art color picture tube with stripe shaped phosphors showing the relationship between the shadow mask and the terrestrial magnetism correcting member.
Figure 8:
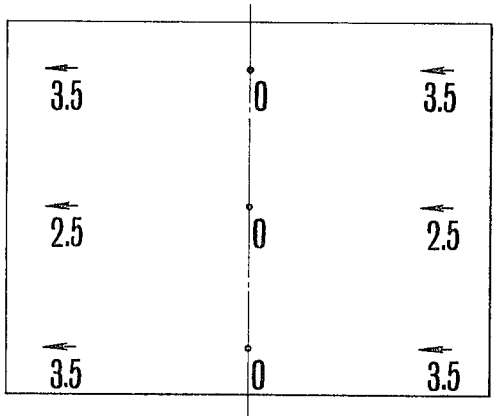
FIG. 8 is a graph showing the distribution of the beam landing error in Japan caused by the vertical component of the terrestrial magnetism when the color picture tube of this invention shown in FIG. 6 is used.
Figure 9:
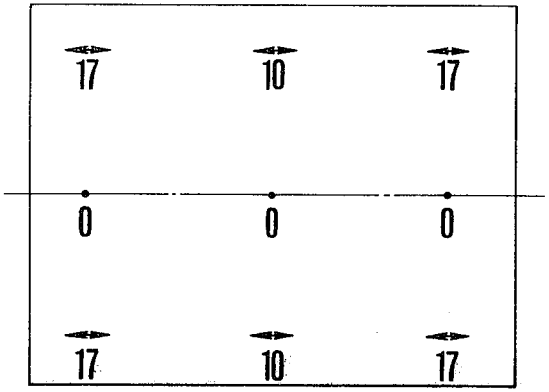
FIG. 9 is a graph showing the distribution of the beam landing error in Japan caused by the horizontal component of the terrestrial magnetism when the color picture tube of this invention shown in FIG. 6 is used.

In addition to not adversely affecting the demagnetizing effect described above, since the terrestrial magnetism correcting member 25 of this invention is provided with upper and lower openings 30 the heat generated or stored in the shadow mask 23*a* due to the impingement of the electron beams is dissipated more rapidly through these openings so that it is possible to more efficiently dissipate the heat than with the prior art correcting member 15 shown in FIG. 5. In one embodiment of the invention the width of the vertical side plates 26 and 27 is made equal to that of the frame 23*b* of the shadow mask assembly 23 and the width of the horizontal side plates 28 and 29 is made to be equal to approximately twice of the width of the metal surface 23*b*, on the incident side of the electron beams of the frame 23*b* of the shadow mask assembly 23. In this structure the beam landing error was measured when the vertical component of the terrestrial magnetism was varied from 0 to 0.7 gauss which correspond to the equator and the north or south pole, respectively, and the result of measurement is shown in FIG. 7. FIG. 8 shows the distribution of the beam landing error after purity adjustment to provide 0.35 gauss which corresponds to the vertical component of the terrestrial magnetism in Japan. Thus, after the purity adjustment, the beam landing error caused by the vertical component is decreased to such an extent that the viewer can scarcely perceive it on the fluorescent screen. As shown in FIG. 9, the beam landing error caused by the horizontal component becomes maximum toward the north and south. Thus, as shown in FIG. 9, according to this invention the overall beam landing error caused by the terrestrial magnetism can be reduced to a value much smaller than the prior art correcting member. More particularly, the horizontal component is also attracted toward the vertical side plates to slightly decrease the intensity of the field at these positions. As a result, the magnetic lines of flux due to terrestrial magnetism are deformed towwards the vertical side plates with the result that the vertical component is strengthened whereas the horizontal component is weakened. Consequently, it is necessary to consider only the horizontal direction error due to the vertical component with regard to the landing error on the stripe shaped phosphors, which means that a decrease in the overall beam landing error is achieved.

Figure 10:
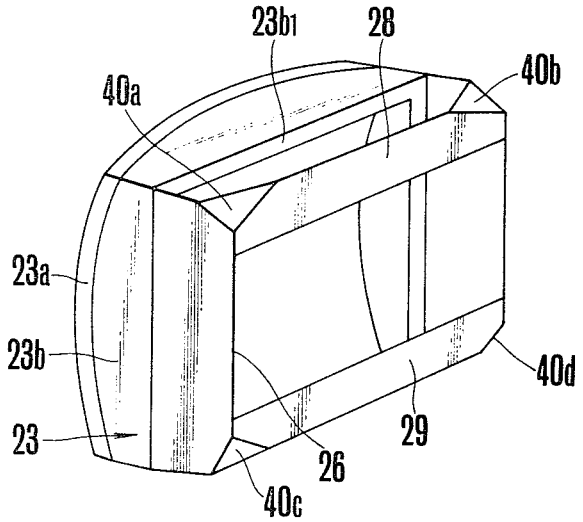
FIG. 10 is a perspective view showing another embodiment of this invention, especially the shadow mask assembly and the terrestrial magnetism correcting member.

FIG. 10 shows a modification of the shadow mask assembly and the terrestrial magnetism correcting member according to this invention which differ from the embodiment shown in FIG. 6. In FIG. 10 inclined magnetic plates 40*a*—40*d* which are substantially parallel with the portions of the inner wall of the funnel at the corners of the envelope, are provided at the joints of the vertical and horizontal magnetic side plates 26, 27, 28 and 29. These plates may be welded to other magnetic plates directly or indirectly.

With this construction, it is possible to project the terrestrial magnetism correcting member more toward the electron gun assembly than with the construction shown in FIG. 6. As this extent of projection increases, the openings 30 and 31 become larger, thus increasing the demagnetizing flux acting upon the shadow mask and the frame thereby increasing the demagnetizing effect.

When the magnetic plates are welded together, the surface treatment, that is blocking thereof can be made simply, thus decreasing the cost of manufacturing.

It should be understood that the invention is not limited to the specific embodiments described above and that many changes and modifications will readily occur to one skilled in the art in the light of the above teachings. For example, instead of providing inclined plates 40*a*—40*d* at the corner joints between the vertical and horizontal side plates the portions of the horizontal side plates near the funnel may be inclined to match the shape of the inner wall of the funnel.

What is claimed is:

1. A color picture tube comprising:

an envelope including an end panel having a plurality of stripe-shaped phosphors thereon forming a fluorescent viewing screen, a funnel portion and a neck portion;

a shadow mask assembly disposed in the enlarged end of said funnel portion at a predetermined distance from said end panel, said shadow mask assembly including a rectangular supporting frame and a shadow mask supported thereby on the side thereof facing said end panel, said rectangular supporting frame comprising a pair of vertically extending short sides and a pair of horizontally extending long sides, said frame being open on the side thereof away from the end panel;

a demagnetizing coil surrounding the enlarged end of said funnel portion in the vicinity of said shadow mask assembly;

a terrestrial magnetism correcting assembly comprising a pair of terrestrial magnetism correcting vertical side plates having the planar surfaces thereof substantially at right angles to the plane of the end panel, said vertical side plates being disposed adjacent respective short sides of the rectantular supporting frame and being of substantially the same length, and a pair of horizontal side plates extending in the direction of the long sides of said rectantular supporting frame and having the planar surfaces thereof substantially perpendicular to the vertical side plates and parallel to the end panel, said horizontal side plates being disposed at the top and the bottom ends of said terrestrial magnetism correcting vertical side plates on the sides thereof away from said end panel to thereby form open spaces between said pair of horizontal side plates and said pair of horizontally extending long sides of said supporting frame for the shadow mask assembly to reduce magnetic coupling between said demagnetizing coil and the terrestrial magnetism correcting assembly and to improve the flow of thermal convection currents away from said shadow mask assembly; and an electron gun assembly contained in said neck portion for producing an electron beam that is projected through said funnel portion, the terrestrial magnetism correcting assembly and the shadow mask assembly to selectively impinge on the stripe-shaped phosphors formed on said end panel.

2. A color picture tube according to claim 1 wherein the corner joints between said vertical and horizontal magnetic side plates are shaped to match the shape of said funnel.

3. A color picture tube according to claim 2 wherein said corner joints are parallel with the inner wall of said funnel.

* * * * *